United States Patent [19]

Kondur, Jr.

[11] 4,218,151

[45] Aug. 19, 1980

[54] SERIAL IMPACT CALCULATOR PRINTER

[75] Inventor: Nicholas Kondur, Jr., Riverton, Wyo.

[73] Assignee: LRC, Inc., Riverton, Wyo.

[21] Appl. No.: 889,918

[22] Filed: Mar. 24, 1978

Related U.S. Application Data

[60] Continuation of Ser. No. 732,474, Oct. 14, 1976, abandoned, which is a division of Ser. No. 527,603, Nov. 27, 1974, Pat. No. 3,986,594.

[51] Int. Cl.[2] ..... B41J 19/70; B41J 19/56; B41J 19/94

[52] U.S. Cl. ..... 400/314.1; 400/320; 400/328

[58] Field of Search ..... 400/314, 314.1, 320, 400/328

[56] References Cited

U.S. PATENT DOCUMENTS

| | | | |
|---|---|---|---|
| 3,628,645 | 12/1971 | McFeaters et al. | 400/320 |
| 3,685,629 | 8/1972 | Rott | 400/314.1 |
| 3,800,933 | 4/1974 | Taylor | 400/328 |
| 3,892,304 | 7/1975 | Shakib | 400/320 |
| 3,929,215 | 12/1975 | Hayakawa | 400/328 |
| 3,967,714 | 7/1976 | Potma et al. | 400/125.1 |
| 4,030,588 | 6/1977 | Hanagata et al. | 400/320 |

FOREIGN PATENT DOCUMENTS 50-44021 12/1975 Japan .

*Primary Examiner*—William Pieprz
*Attorney, Agent, or Firm*—John E. Reilly

[57] ABSTRACT

A serial impact printer of the type utilizing a dot matrix print head is specifically adaptable for use as a calculator or adding machine and is characterized by utilizing a common drive source to advance the print head across the paper, advance the paper between printing operations, and selectively advance the print ribbon between the ribbon supply spool and takeup spool. An improved paper-advancing means has been devised which operates in close correlation with the print head drive member to provide a relatively high speed, simplified and inexpensive printer unit; and the ribbon supply spools are so constructed and arranged as to be interchangeable and to permit direct drive through a spool-engaging member on the print head whereby to advance the ribbon in direct response to print head travel.

6 Claims, 9 Drawing Figures

SERIAL IMPACT CALCULATOR PRINTER

This is a continuation of prior application Ser. No. 732,474, filed Oct. 14, 1976, now abandoned, which application is a divisional of application Ser. No. 527,603, filed Nov. 27, 1974, now issued as U.S. Pat. No. 3,986,594, granted Oct. 19, 1976.

This invention generally relates to serial impact printers; and more particularly relates to a novel and improved calculator printer of the type utilizing a dot matrix to print a permanent record on a recording medium of the mathematical operations performed by the printer.

BACKGROUND OF THE INVENTION

Printers are conventionally made up of a paper advancing platen to advance the paper or other recording material from a supply roll in front of a print head, a print head drive shaft to cause the print head to traverse the recording medium, and a ribbon spool with separate drive to reversibly advance the print ribbon between the print head and recording medium for the purpose of impressing a record of various calculations performed by the printer onto the recording medium.

Typically, separate drive sources have been employed to control the movement of the print ribbon, print head and paper-advancing platen. While such drive mechanisms are closely coordinated in order to synchronize advancement of the recording medium, travel of the print head and advancement of the print ribbon, the size and cost of such printers has been such as to preclude their marketing in direct competition with the small handheld, lower cost calculators now on the market; yet there exists a real demand for calculator printers of the type which will provide a permanent or printed record of the mathematical operation of the printer in a size and at a cost competitive with the hand-held calculators. A most important factor in devising a small printer of the type described is to reduce the number and size of drive means required for controlling mechanical movement in the printer, as well as to reduce the horsepower requirements; and at the same time to establish close control over the various mechanical operations to be performed in advancing the paper, the print head and the print ribbon. In addition, the mechanical elements as described should be of the smallest possible size and arranged in the least space so as to meet the requirements of portability and size so desirable in a desk-top or hand-held printer. It is therefore proposed to provide a unique serial impact printer of the type adaptable for use as a calculator, adding machine and the like which employs a common drive mechanism having extremely low power requirements for advancing the recording medium, print head and print ribbon in closely correlated relation to one another within a mimimum of space and specifically in such a way as to permit mounting of all elements on a common support which is packaged within a compact housing.

SUMMARY OF THE INVENTION

It is therefore an object of the present invention to provide for a novel and improved matrix printer particularly adaptable for use for the printing calculator, adding machine, point of sale and data logging market which is extremely compact, portable and highly reliable and efficient in use.

It is another object of the present invention to provide for a serial impact printer in which a common drive mechanism is employed for advancing the recording medium, print head and print ribbon in closely coordinated relation and in such a way as to minimize the number of parts required in performing the mechanical drive operations in a printer.

It is a further object of the present invention to provide for a novel and improved calculator printer having low power requirements and which makes maximum utilization of mechanical movement of the printer to control other related functions.

It is a still further object of the present invention to provide in a matrix printer for a unique form of record medium advancing mechanism operated off of a main print head advancing drive to control incremental advancement of the recording medium along a guide path which firmly supports the recording medium during the printing operation; and wherein means are provided for manual control and adjustment of the recording medium independently of the advancing mechanism.

It is an additional object of the present invention to provide for a novel and improved form of ribbon advancing mechanism including an interchangeable ribbon spool assembly engageable by a drive member carried by the print head in such a way as to be capable of selective, reversible advancement of the print ribbon in direct response to head travel; and in association therewith to provide in the spool mount for a friction-type clutch mounting which will firmly support each ribbon spool while permitting selective advancement by the spool drive member.

The advantages and features of the present invention are exemplified by reference to the preferred form of invention in which a matrix print head of the type which includes a compact arrangement of solenoid actuated print wires to selectively impress different characters onto a recording medium by means of a print ribbon advanced between the print wires and recording medium. The print head is reversibly driven transversely of the direction of movement of the recording medium at a closely controlled rate by a continuous loop, helical drive surface on a cylindrical member which is rotatably driven by a drive member at one end of the cylindrical drive. Paper-advancing rolls, including a platen and pressure roll are arranged in closely spaced, parallel relation to the cylindrical drive member for the print head, one of the rolls being incrementally driven by a drive pawl eccentrically mounted on the print head drive whereby to index the recording medium at the end of each printing cycle of the print head. The drive pawl selectively interengages with a ratchet on one of the paper-advancing rolls to overcome a detent which releasably engages one of the paper-advancing rolls to station the recording medium securely in position during the printing operation. In turn, the detent as well as the paper-advancing rolls are manually releasable to permit manual positioning or adjustment of the recording medium. The recording medium, i.e. paper, advances between the paper-advancing rolls along a resilient guide path which is so arranged as to accurately guide the paper between the rolls and to firmly support it in an upright position during the printing operation.

Advancement of the printing ribbon is coordinated with the print head travel by a ribbon spool drive member mounted on the print head to selectively engage ratchet teeth on the ribbon spool at the end of each margin as the head traverses the recording medium. Each ribbon spool is so constructed and arranged as to exert the proper tension on the print ribbon in its passage between the print head and recording medium while permitting selective advancement of the spool in response to engagement by the drive member. In turn, the drive member is so contructed and arranged as to be selectively engageable with one ribbon spool at a time to advance the print ribbon in one direction only until fully wound upon one of the ribbon spools and thereafter to be reversed to selectively engage the other ribbon spool to cause reverse travel of the print ribbon.

The above and other objects, advantages and features of the present invention will become more readily appreciated and understood from the following detailed description of a preferred form of the present invention when taken together with the accompanying drawings, in which:

DESCRIPTION OF PREFERRED EMBODIMENT

Figure 1:
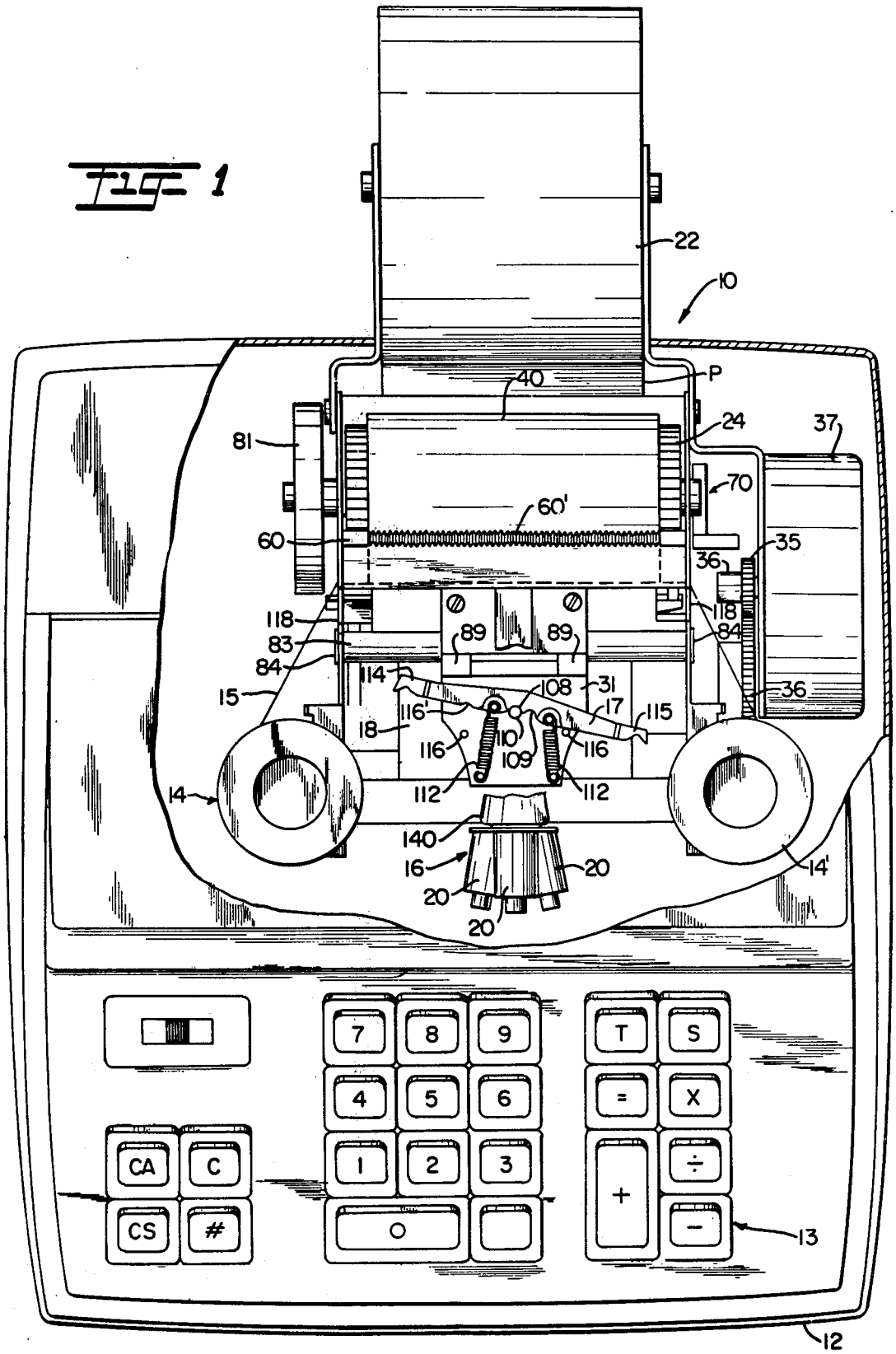
FIG. 1 is a plan view of the preferred form of invention with the outer housing partially broken away to illustrate the print head, drive cam, ribbon and ribbon mounting arrangement.

Referring in detail to the drawings, there is illustrated in FIG. 1 a preferred form of invention which takes the form of a calculator printer 10 having an outer casing 12, a keyboard arrangement 13 in the upper front surface of the casing, a ribbon spool assembly 14 for a print ribbon 15, a print head 16 including a ribbon spool drive arm 17 mounted on the print head and a drive cam 18 for advancing the print head back and forth across a recording medium. As illustrated, the recording medium takes the form of a roll of paper P which is fed off of a paper feed roll 22 and guided along a predetermined path by means of a paper feed assembly 24.

As best seen from FIGS. 2 to 6, the ribbon spools 14, print head 16 and paper feed assembly 24 are mounted in a unitary main support member 25 to be hereinafter described, the main support 25 being permanently affixed between opposite side frames 26 and 27 so as to serve as an extremely compact, lightweight means of support for the entire system.

In the preferred form, the electronics and logic necessary for the system control and character generation do not as such form a part of the present invention and therefore will not be described. Suffice it to say that the various keys on the keyboard 13 as illustrated are intended to perform the necessary calculation through conventional electronic controls and is converted to a combination of electrical signals to control actuation of selected of the solenoid actuators 20 to impart driving motion to print wires 21 carried on the print head to physically strike the ribbon and form a dot matrix character or number on the paper-recording medium P.

Figure 2:
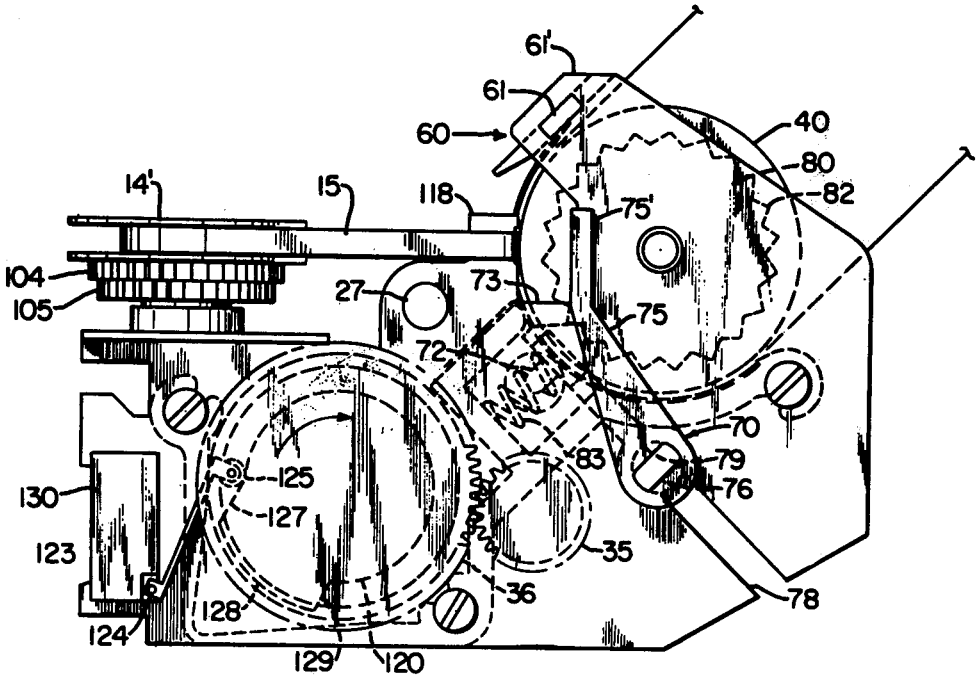
FIG. 2 is one side view in elevation of the preferred form of invention with the housing removed to illustrate the head and platen assemblies.
Figure 6:
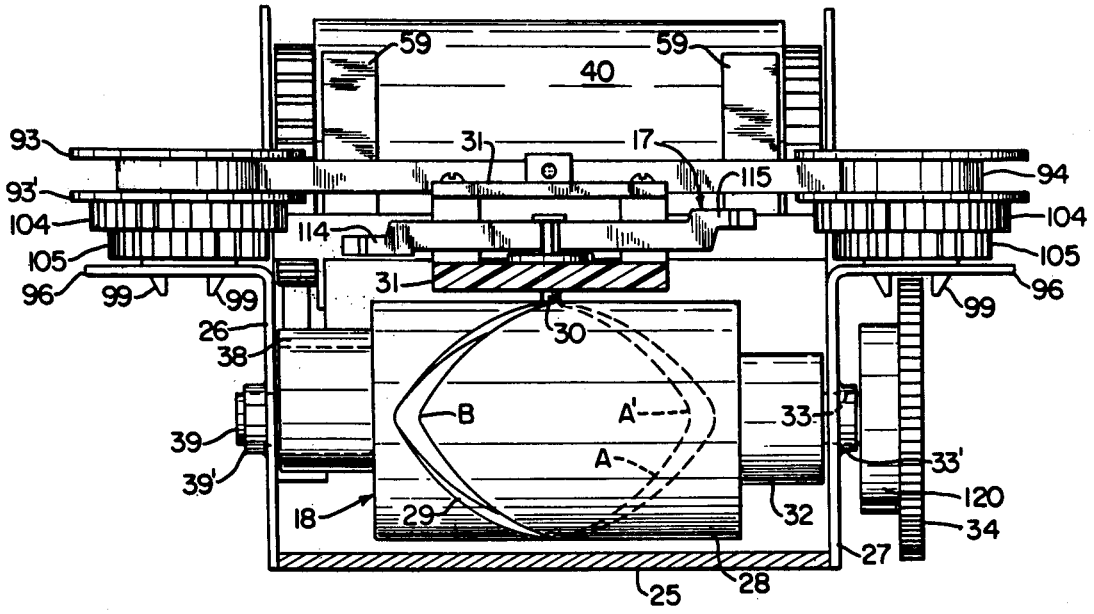
FIG. 6 is a front view in elevation with a portion of the main support broken away to illustrate in more detail the print head and ribbon spool assemblies.

The print head 16 is reversibly driven transversely of the direction of movement of the recording medium by the paper feed 24 at a closely controlled rate of speed by the drive cam 18. As illustrated in FIG. 6, the drive cam 18 includes a main cylindrical portion 28 having a helical groove 29 in the form of a continuous loop which extends along a path from one end of the surface 28 to a point at the opposite end of the drive surface 180° removed and to return along the opposite side of the drive surface to its end point. Moreover, the helical groove is symmetrically formed with respect to the drive surface and is sized to permit insertion of a downwardly projecting stud 30 on the head carrier 31 of the print head 16. The drive cam 18 includes a drive shaft 32, one reduced end 33 being journaled in a bushing 33' in frame 27 and inserted in a speed reduction gear 34 which is driven off of pinion 35 on motor drive shaft 36 of motor assembly 39, as illustrated in FIGS. 1 and 2. The opposite end of the drive shaft 32 has an eccentric drive sleeve 38 thereon, and a reduced end 39 of the drive shaft 32 is journaled in a bushing 30' on the side frame 26.

Figure 4:
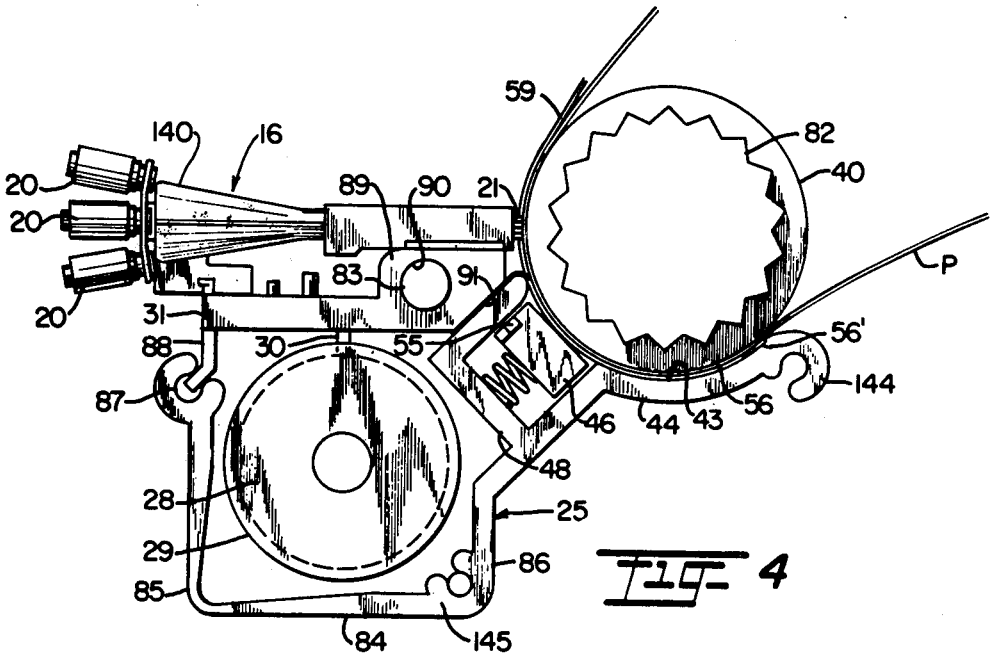
FIG. 4 is another side view of the side shown in FIG. 2 with the housing and portions of the side frame removed.
Figure 5:
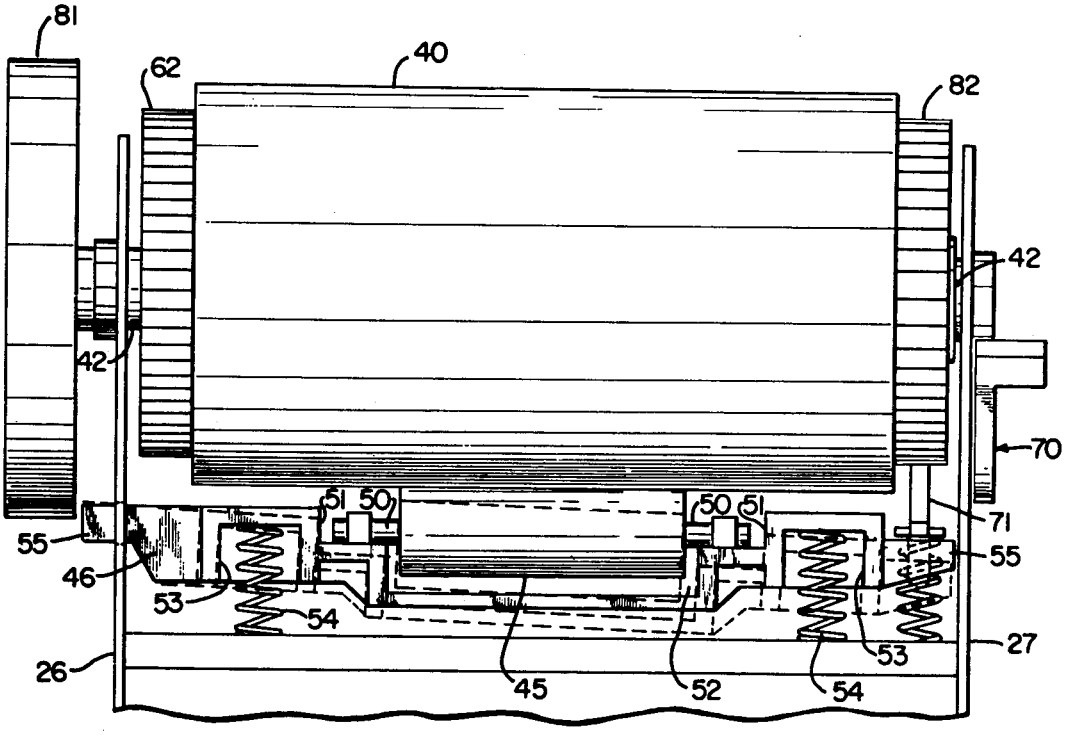
FIG. 5 is a front view with the housing removed illustrating the main support and paper feed arrangement in particular detail.

An important feature of the present invention resides in the paper feed 24 and its operation off of the drive cam 18 to incrementally advance the paper P from the feed roll 22 along a guide path extending directly behind the print ribbon 15. As shown in FIGS. 2 to 5, the paper feed assembly 24 includes a platen 40 in the form of an enlarged cylindrical roller having stub shafts 41 and 42 at opposite ends inserted through aligned openings at the upper and rearward ends of the frames 26 and 27 so that the platen 40 is journaled with respect to the frame. In this position, the platen has its outer cylindrical surface disposed in closely-spaced relation and conforming to the configuration of the inner concave surface 43 of an arcuate cradle or bed 44 in the main support 25. As shown in FIGS. 4 and 5, a pressure roll 45 is inserted in a support block 46, the latter being yieldably supported in channel 48 of the main support 25 which is located directly above the concave surface portion 43. The pressure roll 45 is in the form of a cylindrical member having opposite ends 50 of reduced diameter seated in grooves 51 communicating with a central recess 52 in the support block 46. The support block is of oblong shape having spring-receiving counterbores 53 outwardly of and extending in a direction opposite to that of the central recess 52 for insertion of coil spring 54 which normally urge the pressure roll 45 outwardly from the channel 48 against the external surface of the platen 40. The support block 46 also has extension wings 55 of reduced size at opposite ends for a purpose to be hereinafter described.

Figure 8:
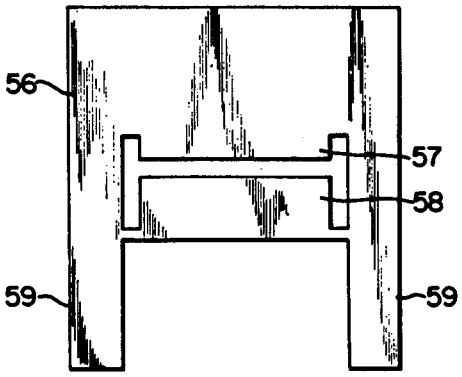
FIG. 8 is a plan view of the resilient strip forming a part of the paper feed assembly.

A plastic guide strip 56, shown in detail in FIG. 8, is preferably formed of a generally rectangular sheet of limited resiliency which is bonded or otherwise secured along one edge 56' to the concave surface portion 43 and has inwardly directed flaps 57 and 58 which are bent out of an intermediate portion of the guide strip for disposition along opposite sides of the channel 48 so as to form an opening therebetween for projection of the pressure roll 45 into direct contact with the surface of the platen 40. The flaps also serve to normally urge the guide strip 56 away from the concave surface whereby to yieldingly press against the paper P as it is directed from the feed roll forwardly along the underside of the platen 40 and into the guide path formed between the platen 40 and the guide strip 56.

The guide strip 56 also has extension fingers 59 which project upwardly in the plane of the strip beyond the pressure roll 45 and somewhat rearwardly behind a tear-off blade 60 so as to complete the guide path for advancement of the paper. Specifically, the paper is guided between the guide strip 56 and surface of the platen 40 until engaged by the pressure roll 45 whereby rotation of the platen will cause continued advancement of the paper upwardly past the ribbon and the upper serrated cutting edge 60' of the tear-off blade 60. Thus, the extension fingers 59 will resiliently support the paper upwardly in its travel away from the print area located on the platen surface directly behind the path of travel of the print ribbon 15. The tear-off blade 60 has tabs 61 at opposite ends mounted in slots formed in brackets 61' forming upward extensions of the frames 26 and 27.

Figure 3:
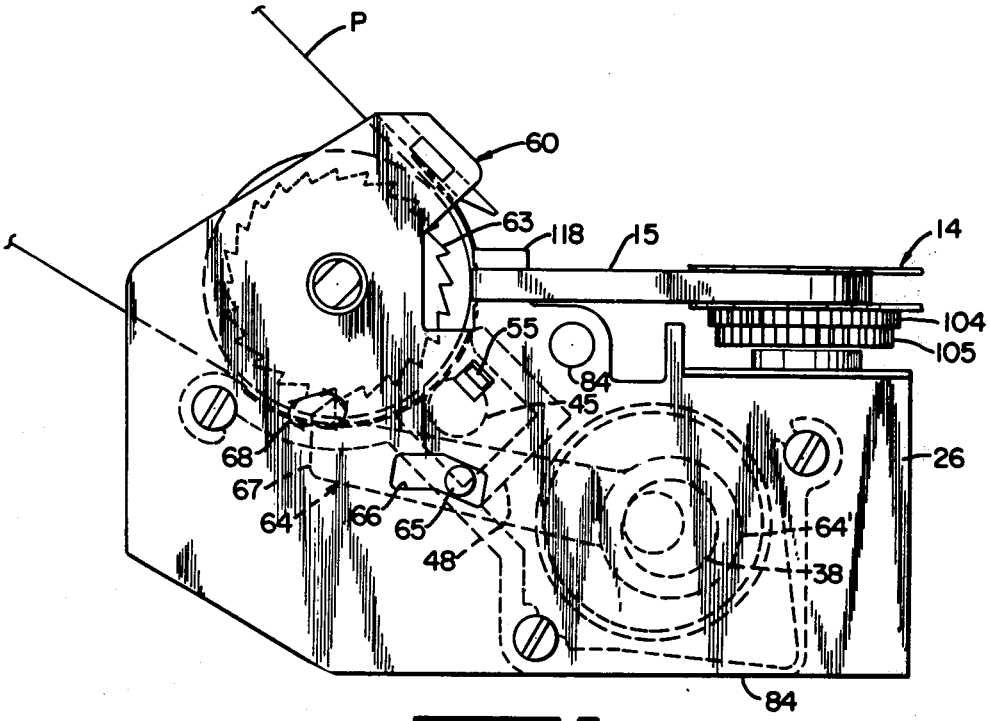
FIG. 3 is a view taken from the side opposite to that shown in FIG. 2 with the housing removed and showing in particular the eccentric and pawl relative to the paper feed arrangement.

In order to advance or rotate the platen, a ratchet wheel 62 is keyed to one end of the platen 40 with ratchet teeth 63 on the external surface disposed in the path of movement of a drive pawl arm 64, as seen from FIG. 3. The arm 64 has a circular end 64' journaled for rotation at one end on the eccentric sleeve 38 at the end of the drive cam 18 for rearward generally horizontal extension of the arm 64 therefrom. A pin 65 projects outwardly in a lateral direction from the side of the arm for insertion in a slot 66 in the side frame 26, and the arm terminates in a pawl or catch 67 for selective engagement with one of the ratchet teeth on the gear 62. It will be seen from the motion outlined by the arrows and designated 68 in FIG. 3 that the free end or pawl 67 of the arm 64 will describe a generally oval-shaped path of movement into and away from engagement with one of the ratchet teeth in following the rotational movement of the opposite end about the eccentric 38 and which is translated into a more nearly linear movement by the pin 65 riding in the angular, generally V-shaped slot 66. Movement in the manner shown and described will cause the pawl to swing upwardly into engagement with one of the teeth to carry the platen in a clockwise direction, as viewed in FIG. 2, over a limited distance to advance or index the paper one line or space; and thereafter to swing downwardly to return to its original position in response to rotation of the drive cam 18.

In advancing the platen 40 through the interaction of the pawl 64 and ratchet gear 62, the pawl arm 64 will overcome the holding action of a detent 70. As shown in FIGS. 2 and 5, detent 70 is comprised of an inner arm portion 71 having a downwardly directed finger 72, a protuberance 73 extending in a direction opposite to that of the finger 72 and an outer distal end portion 74. A handle 75 is affixed to the arm 71 by a common boss 76. The boss has flatted surfaces 77 to permit insertion of the boss 76 through a keyhole-shaped slot 78 in the rearward lower end of the frame 27, the slot 78 including an enlarged circular portion 79 at its inner closed end so that the boss can be inserted by aligning the flatted surfaces 77 with the open slotted entrance until it reaches the enlarged circular portion 79 at which point it will become locked in the slot while free to undergo limited rotation. The detent is aligned in the slot such that the finger 72 projects downwardly into the channel 48 with the oppositely directed protuberance or catch 73 extending upwardly to make engagement with one of the grooves 80 formed in the outer peripheral surfaces of a circular stop element 82 mounted on the end of the platen 40 opposite to that of the ratchet gear 62. A coil spring 83 encircles the finger 72 and abuts the bottom of the channel so as to yieldingly urge the detent arm 71 in a direction forcing the protuberance or catch 73 into one of the grooves 80. The handle portion 75 projects upwardly and somewhat forwardly along the outside of the frame 27 and includes an offset portion 75' provided with a knurled end surface which is accessible for manual engagement externally of the casing of the printer.

When the handle 75 is manually depressed in a downward direction it will cause the finger 72 to overcome the urging of the spring and release the catch 73 from engagement with the groove; and simultaneously the finger abutment will engage one of the wings 55 of the support block 46 to cause the pressure roll 45 to be depressed away from the platen surface whereby to permit manual adjustment or positioning of the paper when desired. When the handle 75 is released, the catch 73 will automatically return under the urging of the spring behind the finger 72 to a position engaging the stop 82 and the pressure roll 45 will return into engagement with the platen. In this relation, the drive pawl 64 must overcome the detent arm in advancing or indexing the platen. Accordingly, the spacing between grooves 80 on the stop 82 is such that as the drive pawl 64 clears the ratchet gear 62 the catch 73 will move into engagement with the next groove on the stop 82 to accurately index the paper to a predetermined spacing between each line of print. A twirler or hand wheel 81 is keyed to the reduced end 42 of the platen to permit manual rotation of the platen 40 and indexing of the paper P.

In order to mount the print head 16 in alignment with respect to the platen 40 and the cam drive 18, the main support 25 includes a front channel-shaped recess 84 within which the cam drive 18 is supported by the side frames 26 and 27, the recess 84 having opposite front and rear side walls 85 and 86, respectively, and the front wall terminating in an upwardly directed, rearwardly inclined groove 87. Groove 87 receives a downwardly and forwardly inclined slide member 88 on the head carrier 31 so as to served as a front guideway for the print head 16. The body of the head carrier 31 is of a flat generally rectangular configuration and has a pair of spaced horizontal extension arms 89 extending rearwardly toward the platen 40, the arms 89 being provided with openings 90 to receive a cylindrical support rod 83. Each extension arm 89 is also provided with an inclined bearing surface 91 which rides on the upper flap portion 58 of the guide strip 56. The support rod 83 is fixed at opposite ends to the side frames 26 and 27 to cooperate with the groove 87 in supporting the head carrier for slidable movement of the print head 16 during the printing operation. The print head described is permanently affixed on the upper surface of the head carrier 31 in order to follow movement of the head carrier as it is driven through the stud 30 by the cam drive 18. Briefly, the cam drive 18 and specifically the helical grooved surface 29 will when rotated impart translational movement to the head carrier in a direction to cause the print head to travel back and forth between opposite margins of the paper P or other recording medium.

Figure 7:
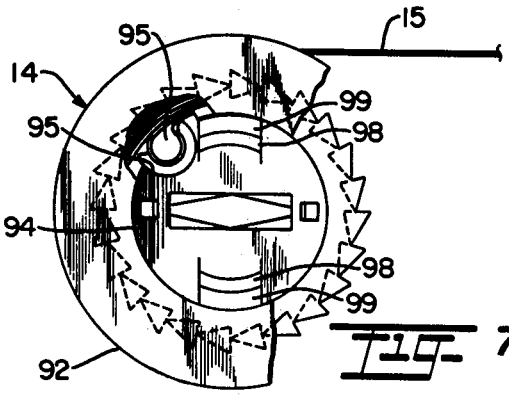
FIG. 7 is a detailed plan view of one of the ribbon spools and the print ribbon with a portion of the spool broken away.

Simultaneously, the ribbon 15 is advanced between the ribbon spools 14 and 14' under the control of the toggle arm 17 which is shiftably mounted on the print head 16. Each ribbon spool 14 and 14' is constructed in an identical manner, and accordingly, only one ribbon spool is illustrated in detail in FIG. 7. As shown, each spool correspondingly includes a bobbin 92 having upper and lower flanges 93 and 93' on opposite sides of cylindrical surface 94 around which the ribbon is wound. A groove or pocket 95 is indented into the surface 94 in closely surrounding relation to a pin 95' to permit each end of the print ribbon to be frictionally held in place around the pin in a conventional manner.

Each ribbon spool is inserted in snug-fitting engagement with the edge of an opening formed in each bracket 96 which projects laterally in an outward direction from the front end of the frames 26 and 27. Each of the spools 14 and 14' is removably secured on a respective bracket 96 by diameterically opposed fingers 98 having enlargements 99 at their lower ends which are adapted to advance into snapfitting engagement with the undersurface of each bracket. A pair of resilient, downwardly projecting legs 100 are disposed at 90° to the fingers 98 and are interconnected by a resilient beam or spring element 102 which exerts an outward biasing force on the legs to urge them against the inner edge of the opening in each bracket 96 so as to act as a friction clutch which will resist turning movement of the ribbon spool within the opening.

In order to positively advance the print ribbon 15 between the spools, upper and lower sets of ratchet teeth 104 and 105, respectively, are interposed between the bobbin and lower mounting portion. It will be noted that the ratchet wheel 105 is of slightly less diameter than the ratchet wheel 104; and further as best seen from FIG. 7, the upper ratchet teeth extend in a direction opposite to those of the lower ratchet teeth so as to permit interchangeable use of each ribbon spool 14 or 14' on either side of the printer in a manner to be hereinafter described. The ratchet drive arm 17 is comprised of an elongated bar having shallow grooves or depressions 108 and 109 in side-by-side relation to one another intermediately of and symmetrically about the center of the bar for shiftable mounting with respect to an upstanding pivot pin 110 on the upper surface of the body of the head carrier. Spring elements 112 are disposed on opposite sides of the grooves 108 and 109 for extension forwardly of the arm 17 and mounting at the front corner of the head carrier 31. A rearwardly directed pawl or catch 114 is located at one extremity of the arm and a correspondingly formed pawl or catch 115 is located at the opposite end of the arm; however the pawl 115 is offset upwardly from the plane of the arm 17 while the pawl 114 is offset downwardly. In this way, and as best seen from FIG. 6, the pawl 114 will be aligned with the lower ratchet wheel 105 and the pawl 115 will be horizontally aligned with the upper ratchet wheel 104.

One of the rearwardly directed pawls 114 or 115 is adapted to engage the ratchet teeth on one of the ribbon spools in the following manner: The arm 17 is shiftable rearwardly under the urging of one of the springs 112 depending on which groove 108 or 109 is resting against the pin 110 so that the pawl which is at the greater distance from the pin is displaced forwardly to engage the ratchet teeth just prior to the end of travel of the print head 60 and will overcome resistance of the friction clutch mounting to cause stepping of the ribbon spool and resultant winding of the print ribbon upon the spool so as to present a new ribbon surface for printing. When the print ribbon becomes fully wound upon one spool the tension or resistance to further turning of the spool is such as to cause the drive arm 17 to be longitudinally displaced and to shift the other groove into engagement with the pin 110. The resultant shift in moment arm will cause the opposite pawl to be drawn forwardly under the urging of its spring member 112 so that the pawl will engage the ratchet teeth on the other ribbon spool at the end of travel of the print head 16. Since the opposite pawl is offset to engage the lower set of ratchet teeth from the other ribbon spool it will cause rotation of the spool in a direction opposite or in reverse to that of the first spool so as to reverse the direction of advancement of the print ribbon so as to be unwound from the first spool onto the other spool. The drive arm 17 is limited in its pivotal movement about the pin 110 by limit stops 116 which are defined by upstanding pins mounted on the upper surface of the body of the head carrier 31. The print ribbon 15 is guide for straightline, horizontal advancement past the print head 16 by guide flanges 118 which extend upwardly from the frame members 26 and 27 just forwardly of and at opposite ends of the front surface of the platen 40, as shown in FIGS. 1 to 3.

The difference in diameter or size of the ratchet wheels 104 and 105 is dictated by the fact that the ratchet teeth on each ribbon spool 14 and 14' are oppositely directed so as to be interchangeable for use either at the left or right hand margin. As a result, in molding the ribbon spools, for example, from a plastic material it would be very difficult to part the mold along the oppositely directed ratchet tooth surfaces if the ratchet wheels were of the same diameter. By forming the lower ratchet wheel of a lesser diameter, the mold can be more readily parted. In order to compensate for this difference in diameter between the ratchet wheels, most desirably the slight depression 116' is formed in the surface of the arm 17 on the side of the arm which carries the lower offset pawl 114 so that the pawl 114 is displaceable forwardly a slightly greater distance for movement into engagement with the ratchet teeth on the lower ratchet wheel 105.

In order to drive the print head 16 through a complete cycle of operation in printing from right to left across the recording medium and returning from left to right back to a home or start position, the drive cam 28 is rotated to cause the head carrier stud 30 to advance from a starting point or home position A on the helical drive surface 29, as shown in FIG. 6, reverse its travel as it crosses A' to advance to the left through point B which is located on the diametrically opposed surface of the cam drive, then will cause the carrier to reverse itself again and return to the original starting point A. As the print head 16 is advanced from right to left, as viewed in FIG. 6, the eccentric drive arm 64 is being driven rearwardly and upwardly to move into engagement with the ratchet wheel 62; and as the print head 16 completes its traversal of the platen surface and approaches the left hand margin, the drive arm 64 will advance into the position illustrated in FIG. 3 in preparation for engagement with the ratchet 62. As the print head 16 is reversed by the drive surface 29 to return to its starting position, i.e., in traveling from left to right across the recording medium, the drive arm 64 will continue to swing upwardly and to advance forwardly into engagement with the ratchet 62 whereby to index the ratchet in a counterclockwise direction forcing the recording medium or paper P to advance one line in preparation for printing the next line in succession. When the print head 16 returns to its home position, the arm 64 will have cleared the ratchet 62 and will have reached its forward limit of travel under the control of the eccentric 38.

Figure 9:
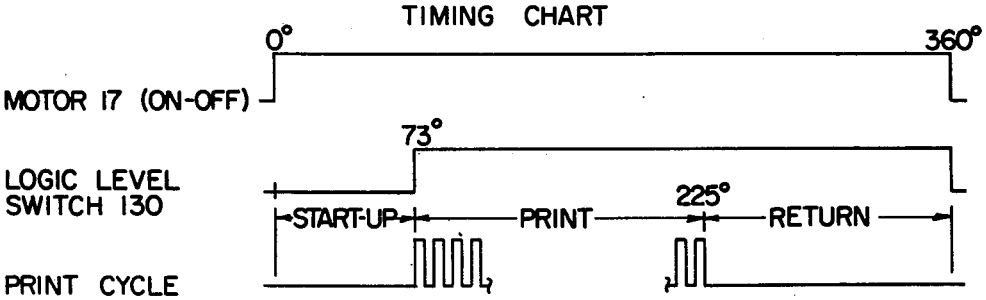
FIG. 9 is a timing chart of the print head operation through a print cycle.

In order to further correlate advancement of the print head with each desired printing operation, the cam drive 18 is provided with a switch control cam 120 which is mounted on the reduced end 33 of the cam drive just inwardly of the gear 34 and includes a radially projecting cam surface 122 which is engaged by a leaf spring arm 123 of a logic level switch 130, the latter mounted at the front edge of frame 27. The spring arm 123 is pivoted at its lower end 124 to the switch box and has a roller 125 at its upper free end which is caused to pass along the radially extending cam surface 127, across outer circumferential surface 128 and inwardly along radial surface 129 to control opening and closing of the logic level switch represented at 130. As seen from FIG. 9, the logic level switch is turned off by outward and forward movement of the control arm 123 along the surfaces 127 and 128 as the print head is advanced from home position A through point A'. The switch 130 will activate the print circuit when the arm 123 moves inwardly along surface 129 as the print head starts its travel from right to left in printing on the recording medium. In the preferred form of invention, the helical drive surface 29 will, at the starting position of each print cycle, engage the stud 30 a limited distance represented at point A ahead of the dwell portion A'. In a synchronous motor drive this start-up interval will permit the motor to gradually build up to the desired rate of speed for advancing the print head 16 at a constant velocity from right to left across the paper P as the drive roller is continuously rotated as the cam 28 is driven in a clockwise direction as shown in FIG. 2. Specifically, the stud 30 will be advanced from the start position A through the dwell portion A' and will undergo controlled acceleration, as it is reversed in direction, to reach a constant velocity for printing from right to left. At the end of the printing stage, the stud 30 will rapidly decelerate as it is forced to reverse its direction of travel at the left hand margin B. Thereafter, the stud 30 will be returned at a faster rate of speed to its home position A. The configuration of the drive surface 29 will control the rate of speed of the print head 16 as described; and accordingly the turn at the reverse position B is much sharper than at the dwell position A'. A particular advantage of the drive surface 29 is that it lends itself to a synchronous motor drive, since the initial movement from the home position A through dwell position A' will avoid any instability of the motor in building up to speed as a preliminary to printing in each cycle. One suitable form of motor 17 is the Molon LMO motor manufactured by Molon Motor & Coil Corp. and which is a twenty-four pole permanent magnet synchronous motor.

The print head as represented at 16 comprises a series of five vertically aligned print wires 21 which converge forwardly through a guide housing illustrated at 140, and the wires 21 are operated by a corresponding number of solenoid actuators 20 mounted on the forward end of the guide housing 140. The necessary control circuitry for operation of the motor drive and print head is housed beneath the keyboard area 13 and, since it forms no part of the present invention, will not be described.

It will be appreciated from the foregoing description that a compact printing apparatus has been devised which is particularly adaptable for use in calculator or adding machine operations. All of the working elements are integrated into an extremely compact package wherein the primary means of support is defined by the opposite side frame members 26 and 27 interconnected by the main support member 25. In this relation, the main support includes three principal points of attachment at opposite ends of the frame which are defined by screw-receiving bores at opposite ends of the forward grooved portion 87, a rearward downwardly directed groove portion 144 and a lower grooved portion 145 at the corner between the bottom wall 84 and rearward side wall 86. In addition, the guide rod 83 for the head carrier has upset end portions 84 outwardly of the frames 26 and 27 so as to rigidly interconnect the frame members together. Although the paper feed supply roll 22 is illustrated as extending rearwardly from the end of the casing 12, it may be readily mounted more directly beneath the platen and housed within the same casing so as to be fully contained within the casing. The paper as it is advanced along the guide path formed between the guide strip 56 and the platen surface will follow the path as illustrated in FIG. 3. Most desirably, the guide strip is composed of a plastic material having a low coefficient of friction. By mounting the flaps 57 and 58 on opposite sides of the pressure roll channel in the manner described, the guide strip will be urged upwardly somewhat against the paper so as to be yieldingly urged against the platen surface without impeding advancement of the paper across the path of the print head. The head carrier 31 is preferably composed of a material having an extremely low coefficient of friction such as Teflon so as to provide excellent bearing surfaces for slidable movement of the head carrier both with respect to the support rod 83 and the groove 87.

It will be evident that, although the preferred form of apparatus has been described specifically in relation to its use in calculator printers, it is readily conformable for use in other printer applications and in other types of printers than matrix printers. It is therefore to be understood that various modifications and changes may be made in the preferred form of invention without departing from the spirit and scope of the present invention as defined by the appended claims.

What is claimed is:

1. In a printing apparatus having a frame and a print head carrier including a print head selectively actuated by actuating means associated with said head to impress characters on a recoridng medium, a pair of recording medium advance rollers mounted for rotation on spaced parallel axes with the external roller surfaces engageable with one another to define a common guide path for advancement of the recording medium therebetween, the improvement comprising:

rotatable print head drive means engageable with said print head carrier to reversibly drive said print head in a print and return direction transversely of the direction of advancement of the recording medium, said drive means including drive surface means in the form of a continuous loop having points of reversal at opposite portions thereof, said points being aligned with the desired end limits of travel of said print head, said print head carrier including a drive member engageable with said drive surface means to impart linear reversible movement to said print head when said continuous loop is advanced;

incremental advancing means including an eccentric member mounted for rotation with said print head drive means and a follower arm constrained for movement along the surface of said eccentric member, said follower arm responsive to movement of said eccentric member when said print head drive means and said drive member are advanced in a return direction to incrementally drive one of said recording medium advance rollers in a direction causing incremental advancement of the recording medium; and motor drive means for driving said continuous loop to impart linear mvement to said print head.

2. In a printing apparatus according to claim 1, wherein said continuous loop being formed on a generally cylindrical roller without intersecting itself, said roller journaled for rotation on said frame and said end points of reversal adjacent opposite ends of said roller at points 180° removed from one another.

3. In a printing apparatus according to claim 2, said motor drive means having a synchronous motor as its motive drive source, said drive surface means defined by a generally helical groove formed in the surface of said roller, said head carrier having a drive member in the form of a downwardly projecting stud inserted in said helical groove to advance in a linear direction across the top surface of said roller as said roller is continuously rotated.

4. In a printing apparatus according to claim 1, said drive surface means being operative to initiate movement of said print head carrier in a return direction and to reverse its direction of travel at a first point of reversal of said loop to advance in the print direction as said roller is accelerated to a constant velocity by said motor drive means.

5. In a printing apparatus according to claim 4, said drive surface means being further operative to decelerate said print head at the opposite point of reversal of its loop and to reverse its travel for movement in a return direction to a position short of said first point of reversal of said loop.

6. In a printing apparatus according to claim 5, said continuous loop being a generally helical groove formed without any intersections on a generally cylindrical roller, said groove having a greater radius of curvature at one end limit of travel of the print head than at the opposite end limit of travel so that the rate of deceleration of said print head preliminary to travel in the print direction is at a reduced rate with respect to the rate of deceleration of said print head preliminary to travel in the return direction.

* * * * *